US010251475B1

(12) United States Patent
Guffey

(10) Patent No.: US 10,251,475 B1
(45) Date of Patent: Apr. 9, 2019

(54) WHEELCHAIR ACCESS SYSTEM

(71) Applicant: Nathan Guffey, Seymour, TN (US)

(72) Inventor: Nathan Guffey, Seymour, TN (US)

( * ) Notice: Subject to any disclaimer, the term of this patent is extended or adjusted under 35 U.S.C. 154(b) by 0 days.

(21) Appl. No.: 15/674,855

(22) Filed: Aug. 11, 2017

(51) Int. Cl.
*A47B 1/04* (2006.01)
*A47B 1/05* (2006.01)

(52) U.S. Cl.
CPC ..... *A47B 1/05* (2013.01); *A47B 2200/13* (2013.01)

(58) Field of Classification Search
CPC ..... A47B 1/05
USPC ..... 108/77, 78, 83, 87, 89; 312/291, 301
See application file for complete search history.

(56) References Cited

U.S. PATENT DOCUMENTS 840,783 A * 1/1907 Lisee ..... A47B 1/05 108/73
844,616 A * 2/1907 Peek ..... A47B 1/05 108/75
970,634 A * 9/1910 Matheson ..... A47B 1/04 108/78
1,887,114 A * 11/1932 Benson ..... A47B 1/05 108/75
1,894,220 A * 1/1933 Kelly ..... A47B 1/05 108/86
1,901,108 A * 3/1933 Landaw ..... A47B 1/05 108/136
2,017,298 A * 10/1935 Swanson ..... A47B 1/05 108/75
2,092,244 A * 9/1937 Charak ..... A47B 1/04 108/77
2,548,927 A * 4/1951 Anderson ..... A47B 1/08 108/150
6,648,430 B2 * 11/2003 Rohde ..... A47B 1/05 108/90
8,342,129 B2 * 1/2013 Harper ..... A01K 5/0114 119/61.5
9,039,080 B2 5/2015 Guffey et al.

* cited by examiner

*Primary Examiner* — Matthew W Ing
(74) *Attorney, Agent, or Firm* — Luedeka Neely Group, PC

(57) ABSTRACT

A system for facilitating access, includes, a tabletop having an undersurface; a tray support movably positioned relative to the undersurface of the tabletop so as to be positionable between a retracted position in which the tray support is inward of the undersurface of the tabletop and an extended position in which a portion of the tray support extends outwardly from the underside surface of the table top; a tray having an upper tray surface; a height extender removably couplable to the tray; and a lock. The lock is operatively associated with the height extender and the tray support, and is configured to position and lock the tray to the tray support when the tray support is in the extended position, and to locate an upper planar tray surface of the tray at a desired height relative to the tabletop.

11 Claims, 6 Drawing Sheets

WHEELCHAIR ACCESS SYSTEM

FIELD

This disclosure relates to the field of access of furniture and the like by persons in wheelchairs. More particularly, this disclosure relates to a wheelchair access system having a height adjustable tray configured for facilitating access of a table or the like by a person in a wheelchair.

BACKGROUND

Tables and like elevated surfaces are often difficult for being accessed by a person in a wheelchair. For example, armrests and portions of a frame of a wheelchair can inhibit a person in a wheelchair from being positioned close enough to the table or like work surface to effectively utilize the table for eating, working, and the like The present disclosure relates to systems for configuring tables and like structures for facilitating access by a person in a wheelchair.

SUMMARY

The disclosure relates to systems for facilitating access.

In one aspect, the system includes a tabletop having an undersurface; a tray support movably positioned relative to the undersurface of the tabletop so as to be positionable between a retracted position in which the tray support is inward of the undersurface of the tabletop and an extended position in which a portion of the tray support extends outwardly from the underside surface of the table top; a tray having an upper tray surface; a height extender removably couplable to the tray; and a lock. The lock is operatively associated with the height extender and the tray support, and is configured to position and lock the tray to the tray support when the tray support is in the extended position, and to locate an upper planar tray surface of the tray at a desired height relative to the tabletop.

In another aspect, the disclosure relates to a wheelchair access system, that includes a wheelchair having armrests spaced a distance apart to define an access width; a tabletop having an undersurface; a tray support movably positioned relative to the undersurface of the tabletop so as to be positionable between a retracted position in which the tray support is inward of the undersurface of the tabletop and an extended position in which a portion of the tray support extends outwardly from the underside surface of the table top; a tray having an upper tray surface, the tray having a length and a width, the width of the tray being less than the access width of the wheelchair; a height extender removably couplable to the tray; and a lock. The lock is operatively associated with the height extender and the tray support, and configured to position and lock the tray to the tray support when the tray support is in the extended position, and to locate an upper planar tray surface of the tray at a desired height relative to the tabletop.

In another aspect, the disclosure relates to a system for facilitating access, that includes a tray support movably positioned relative to a work surface so as to be positionable between a retracted position in which the tray support is inward of the work surface of and an extended position in which a portion of the tray support extends outwardly from the work surface; a tray having an upper tray surface; a height extender removably couplable to the tray; and a lock. The lock is operatively associated with the height extender and the tray support, and configured to position and lock the tray to the tray support when the tray support is in the extended position, and to locate an upper planar tray surface of the tray at a desired height relative to the work surface.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
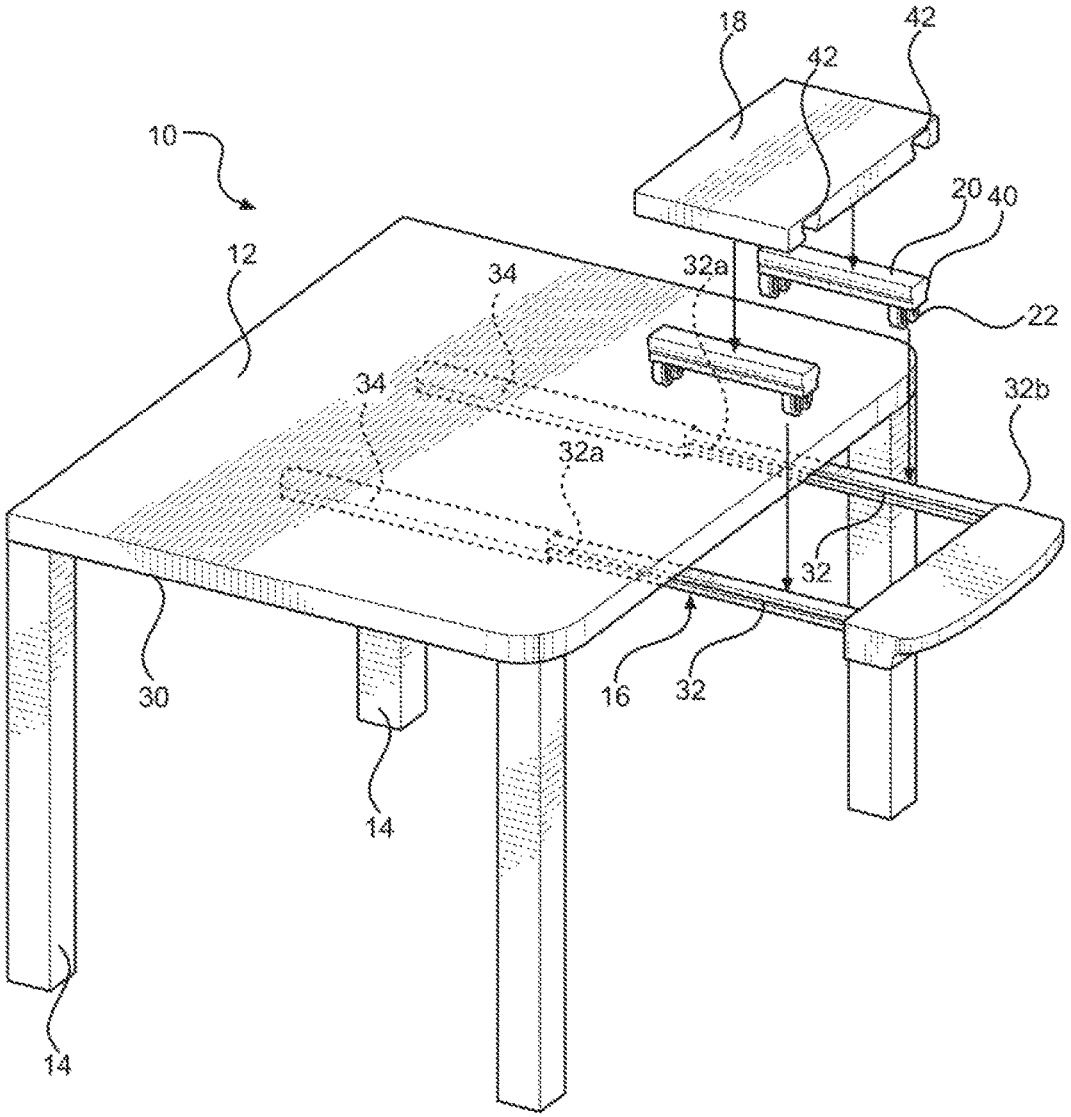
FIG. 1 is a partially exploded perspective view of a wheelchair access system according to the disclosure.

With reference to the drawings, there is shown a wheelchair access system 10 according to the disclosure. The system 10 includes a work surface such as a tabletop 12 supported in an elevated position above a floor or the like. The tabletop 12 is planar and is supported in the elevated position as by legs 14.

The system 12 also includes a retractable tray support system 16 operatively associated with the tabletop 12. A removable tray 18 having height extenders 20 with locks 22 cooperates with the tray support system 16 to permit the tray 18 to be installed and removed as desired.

The tabletop 12 may be otherwise supported in the elevated position. For example, instead of the legs 14, the tabletop 12 might be a surface that extends past the edge of a cabinet or the like. Thus, it will be appreciated that the tabletop 12 may be a variety of elevated surfaces and not necessarily a table. The term tabletop is used broadly to describe a variety of elevated surfaces such as desktops, countertops, and the like to which a person in a wheelchair may desire to utilize for work, hobbies, eating or the like.

Figure 2:
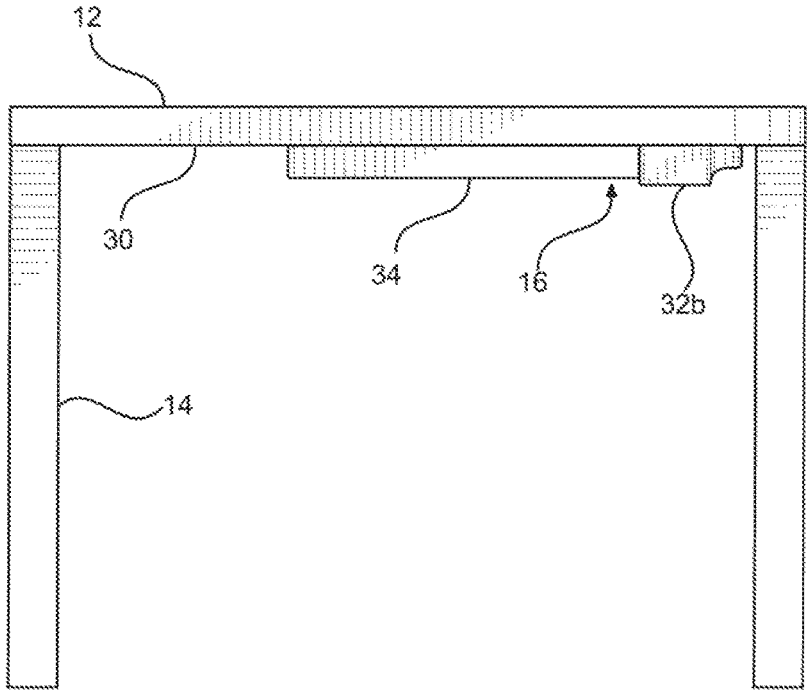
FIG. 2 is a side view of an assembled wheelchair access system according to the disclosure, with a tray support portion located in a storage position, with the tray removed.
Figure 3:
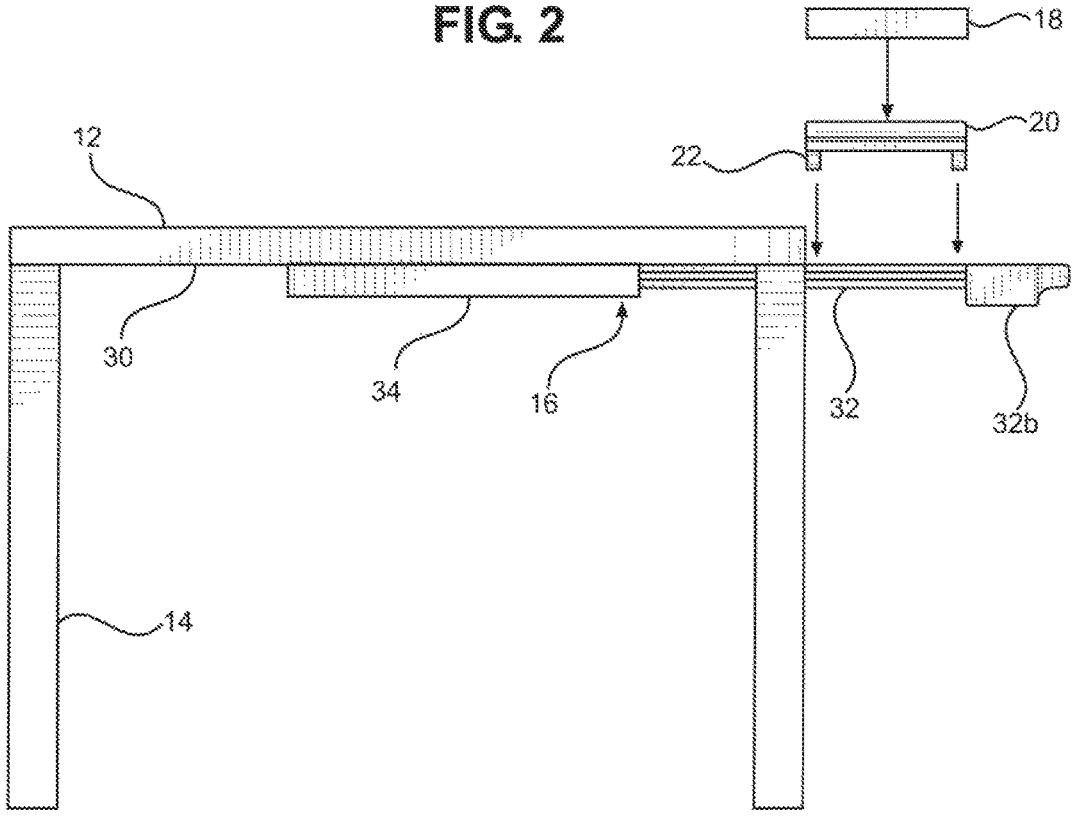
FIG. 3 is a side view of FIG. 1.
Figure 4:
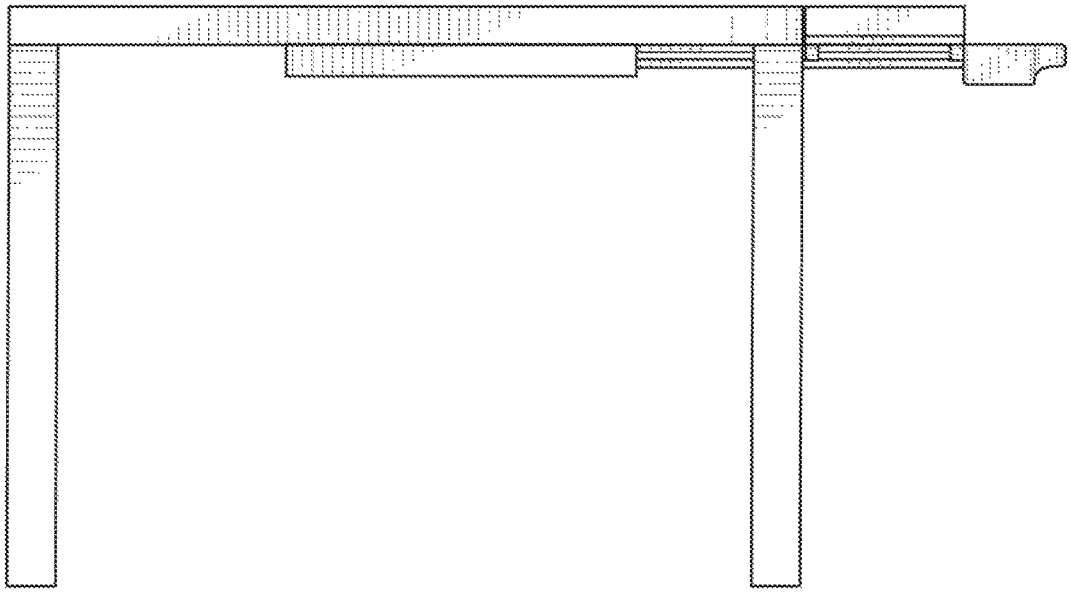
FIG. 4 is a side view of an assembled wheelchair access system according to the disclosure, with the tray support located in a use position and supporting a tray.
Figure 5:
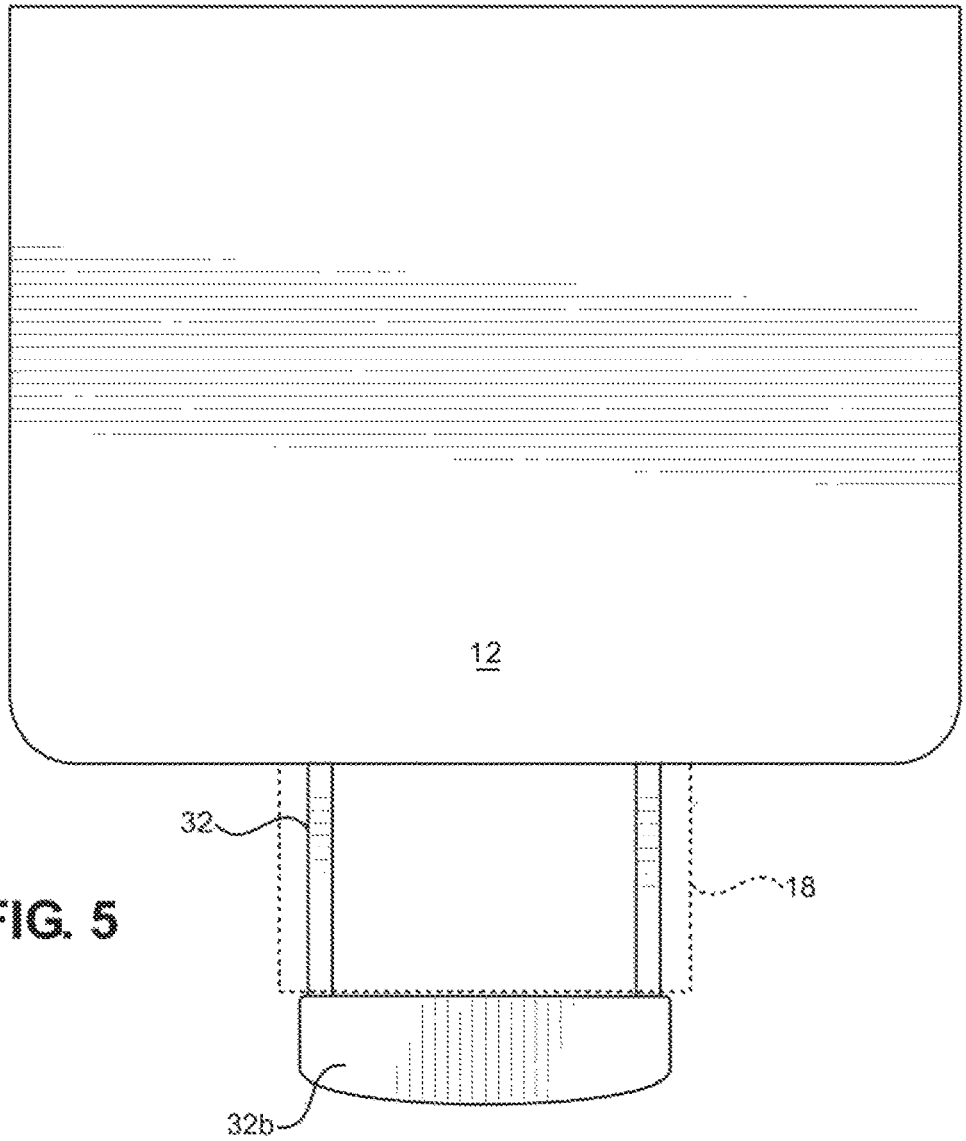
FIG. 5 is an upper plan view of an assembled wheelchair access system according to the disclosure, with the tray support located in a use position and supporting a tray shown in dashed lines.

The tabletop 12 includes an undersurface 30 adjacent to which the retractable tray support system 16 mounts. Included in this is a table or like that has an interior cavity that serves as the undersurface. The retractable tray support 30 has a generally U-shaped frame 32 slidingly positioned adjacent the undersurface 30 of the tabletop 12. The frame 32 has free ends 32*a* and a closed end 32*b*. Mounts 34 are attached to the undersurface 30 and slidingly receive the free ends 32*a* of the frame 32 to permit the frame 32 to be moved between an extended or use position as shown in FIGS. 1, 3, and 4, and a retracted or storage position as shown in FIG. 2.

As seen, the frame 32 is retractable to be hidden underneath the tabletop 12 and out of the way when the tray 18 is not utilized. However, when it is desired for the tray 18 to be utilized, the frame 32 is extended so that portions of the frame 32 and the closed end 32*b* of the frame 32 extend from the tabletop 12 to receive the tray 18. The tray 18 is received between the tabletop 12 and the closed end 32*b* of the frame 32.

Figure 8:
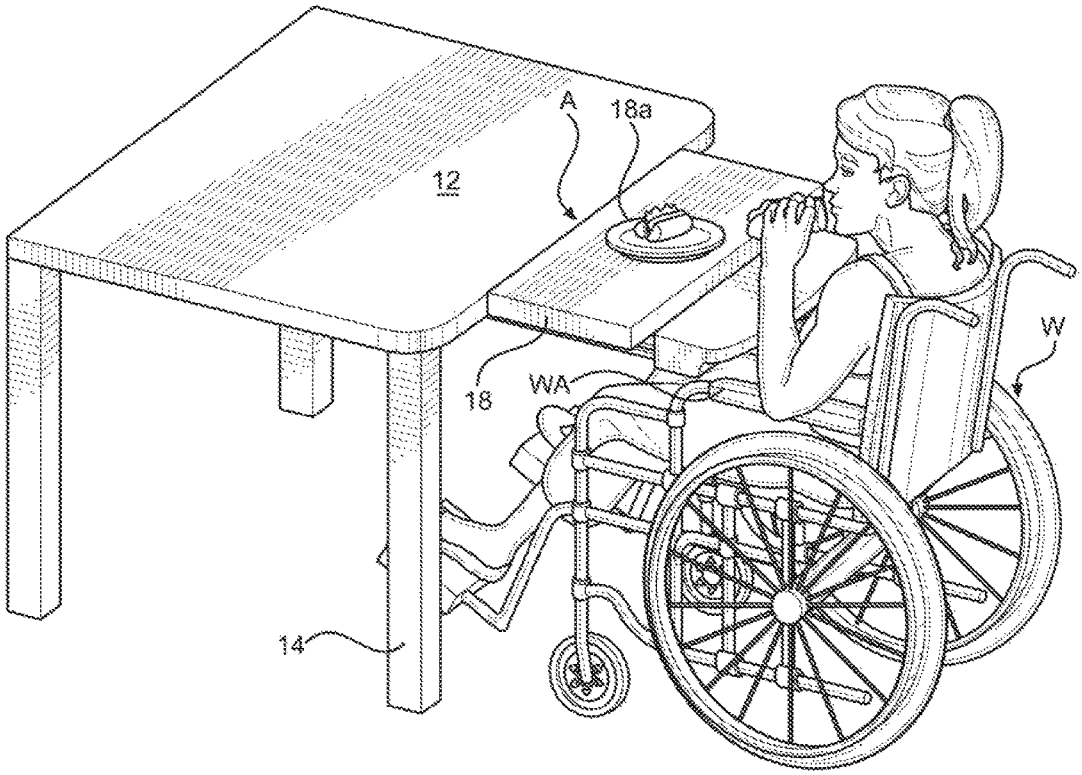
FIG. 8 is a perspective view showing utilization of the wheelchair access system according to the disclosure by a person in a wheelchair.

The frame 32 and the tray 18 are configured to cooperate to facilitate access by a person in a wheelchair W, such as seen in FIG. 8. As seen, the wheelchair W has armrests WA and other portions of the wheelchair W that would contact the tabletop 12 or otherwise inhibit a person in a wheelchair from being positioned close enough to the tabletop 12 to effectively utilize the tabletop 12 for eating, working, and the like. That is, the width between the armrests WA and other portions of the wheelchair W that would contact the tabletop and prevent the wheelchair W from drawing close to the tabletop defines an access width.

As seen, the tray 18 and the frame 32 are of decreased width relative to the access width and are configured to fit between armrests WA and other portions of the wheelchair W to enable the wheelchair W to pull under the tray 18 so that the tray 18 is close enough to the user to effectively utilize the tray 18 for eating, working, and the like. Thus, the tray 18 serves to extend the effective length of the tabletop 12 and facilitate use of the tabletop 12 by a person in a wheelchair.

The tray 18 is installed between the tabletop 12 and the front end 32*b* of the frame 32 during use of the tray 18. As represented by the arrow A in FIG. 8, the tabletop 12 and a top 18*a* of the tray 18 are shown to be flush and co-planar to effectively increase the usable surface area of the tray 18 to include the tabletop 12. This is advantageous for use of the tabletop 12 and the tray 18.

The closed end 32*b* of the frame 32 may be configured to extend upward to also be flush with the tray 18 and the tabletop 12. However, as shown, the closed end 32*b* is lower and provides a shelf or ledge in front of the tray 18. In this regard, the height extenders 20 may be selected to vary or alter the height relationship of the tray 18 relative to the table top 12 and the front end 32*b*.

The height extenders 20 are configured to cooperate with the frame 32 and the tray 18 to render the top 18*a* of the tray 18 co-planar and flush with the tabletop 12 if desired. That is, the extenders 20 fit between the tray 18 and the frame 32 to support the tray 18 so that the top 18*a* is co-planar and flush with the tabletop 12. The system 10 may come with a variety of different sized ones of the extenders 20 so as to enable use with a variety of different tabletops or the like. That is, the extenders 20 are desirably selected to accomplish having the top 18*a* and the tabletop 12 flush and coplanar. However, if desired, the tray 18 may be otherwise located, such as lower or higher than the tabletop 12 if desired.

Figure 6:
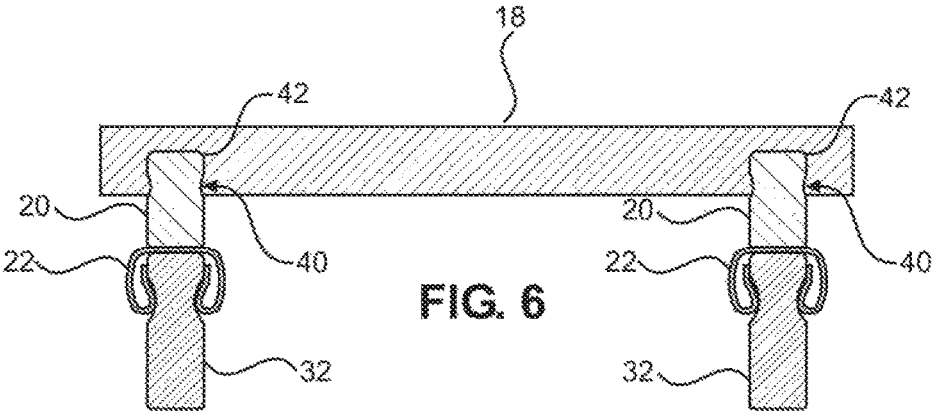
FIG. 6 is an end view showing height extenders and locks associated with the tray installed onto the tray support.

The height extenders 20 may come in various shapes and configurations and may be connected to the tray 18 in various manners. A single extender or multiple extenders may be used. As seen in FIGS. 1 and 6, it is preferred that a pair of the extenders 20 are utilized, and that the extenders 20 are configured as elongate members having upper surfaces thereof configured to provide contoured surfaces 40. The contoured surfaces 40 of the extenders 20 slidingly fit into correspondingly shaped elongate openings 42 formed in the tray 18. In this manner, the extenders 20 may be reliably and rigidly connected to the tray 18, and easily changed out to another size if desired.

It will also be appreciated that if it is desired to have the tray 18 higher or lower than the tabletop, the extenders 20 may be selected to accomplish this as well. Thus, it will be appreciated that the extenders 20 facilitate desired adjustment of the height of the tray 18 relative to the tabletop 12 as well as the front end 32*b*.

Alternatively, the extenders 20 may be formed with the tray 18. For example, if the tray 18 is molded, the height extenders 20 may be co-formed and integral with the tray 18. Then, to provide different tray height options, several trays with different height extenders may be provided with the system.

Figure 7:
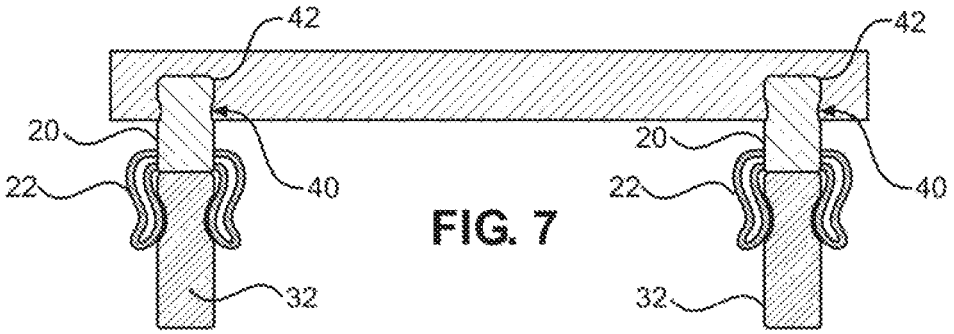
FIG. 7 is end view showing an alternative embodiment of height extenders and locks associated with the tray installed onto the tray support.

The locks 22 are configured to enable the tray 18 to be quickly locked to the frame 32 for installation of the tray 18 to the frame 32 in a manner that reliably maintains the tray 18 fixed to the frame 32. As shown, in FIG. 6, the locks 22 may be provided as by spring clamps that secure to the extenders 20 as by fasteners or the like. The clamps which provide the locks 22 may interface with contoured surfaces of the frame 32 to securely attach. The locks 22 may take a variety of configurations to squeeze, tighten, connect, clamp the tray 18 in place to effectively lock the tray 18 relative to the frame 32. The spring clamps are desirable as they offer secure and quick connection without the use of tools. FIG. 7 shows an alternate embodiment, in which the locks 22 are co-formed with the extenders 20. For example, the locks 22 and the extenders may be of co-molded plastic construction.

As will be appreciated, systems according to the disclosure effectively enable the provision of a height adjustable tray that locks in place, yet is easily removable, and is configured for facilitating access of a table or the like by a person in a wheelchair.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A wheelchair access system, comprising:

a wheelchair having armrests spaced a distance apart to define an access width;

a tabletop having an undersurface;

a tray support movably positioned relative to the undersurface of the tabletop so as to be positionable between a retracted position in which the tray support is inward of the undersurface of the tabletop and an extended position in which a portion of the tray support extends outwardly from the undersurface of the table top;

a tray having an upper tray surface, the tray having a length and a width, the width of the tray being less than the access width of the wheelchair;

a height extender removably couplable to the tray; and a lock operatively associated with the height extender and the tray support, and configured to position and lock the tray to the tray support when the tray support is in the extended position, and to locate an upper planar tray surface of the tray at a desired height relative to the tabletop.

2. The system of claim 1, wherein the upper planar tray surface of the tray is located to be flush and coplanar with the tabletop.

3. The system of claim 1, wherein the tray support comprises a frame slidingly positioned adjacent the undersurface of the tabletop.

4. The system of claim 3, wherein the frame is u-shaped with a pair of free ends and an opposite closed end.

5. The system of claim 1, wherein the lock comprises a spring clamp that secures to the height extender and interfaces with the frame to securely attach the tray.

6. A system for facilitating access, comprising:

a tabletop having an undersurface;

a tray support movably positioned relative to the undersurface of the tabletop so as to be positionable between a retracted position in which the tray support is inward of the undersurface of the tabletop and an extended position in which a portion of the tray support extends outwardly from the undersurface of the table top;

a tray having an upper tray surface;

a height extender removably couplable to the tray; and a lock operatively associated with the height extender and the tray support, and configured to position and lock the tray to the tray support when the tray support is in the extended position, and to locate an upper planar tray surface of the tray at a desired height relative to the tabletop.

7. The system of claim 6, wherein the upper planar tray surface of the tray is located to be flush and coplanar with the tabletop.

8. The system of claim 6, wherein the tray support comprises a frame slidingly positioned adjacent the undersurface of the tabletop.

9. The system of claim 8, wherein the frame is u-shaped with a pair of free ends and an opposite closed end.

10. The system of claim 6, wherein the lock comprises a spring clamp that secures to the height extender and interfaces with the frame to securely attach the tray.

11. A system for facilitating access, comprising:

a tray support movably positioned relative to a work surface so as to be positionable between a retracted position in which the tray support is inward of the work surface of and an extended position in which a portion of the tray support extends outwardly from the work surface;

a tray having an upper tray surface;

a height extender removably couplable to the tray; and a lock operatively associated with the height extender and the tray support, and configured to position and lock the tray to the tray support when the tray support is in the extended position, and to locate an upper planar tray surface of the tray at a desired height relative to the work surface.

* * * * *